US005548980A

United States Patent [19]

Kim et al.

[11] Patent Number: 5,548,980

[45] Date of Patent: Aug. 27, 1996

[54] WASHING TUB FOR LOW FREQUENCY VIBRATION TYPE WASHING MACHINE

[75] Inventors: Jung C. Kim, Seoul; Dong Y. Oh; Gyu S. Choe, both of Kyungki-do; Kyung S. Hong, Inchon-Jikhalsi; Kyung H. Kim, Seoul; Joo H. Lee; Ha I. Lee, both of Kyungki-do; Kyeong B. Park, Seoul; Dong S. Gil, Seoul; Oh H. Kwon, Seoul; Byoung H. Kwon, Busan-Jikhalsi, all of Rep. of Korea

[73] Assignee: Goldstar Co., Ltd., Seoul, Rep. of Korea

[21] Appl. No.: 498,795

[22] Filed: Jul. 5, 1995

Related U.S. Application Data

[63] Continuation of Ser. No. 257,327, Jun. 7, 1994, abandoned.

[30] Foreign Application Priority Data

Jun. 7, 1993 [KR] Rep. of Korea ..... 10228/1993

[51] Int. Cl.[6] ..... D06F 13/00

[52] U.S. Cl. ..... 68/133; 68/3 SS

[58] Field of Search ..... 68/38, 53, 54, 68/133, 23 R, 33.3, 23.6, 23.7, 89, 148, 154, 171, 172, 173, 174, 184, 3 R, 3 SS, 131

[56] References Cited

U.S. PATENT DOCUMENTS

| | | | |
|---|---|---|---|
| 1,250,528 | 12/1917 | Swanson | 68/173 |
| 1,580,778 | 4/1926 | Coverstone | 68/133 |
| 2,158,815 | 5/1939 | Bendix | 68/184 |
| 2,168,068 | 8/1939 | Loweke | 68/184 X |
| 2,176,220 | 10/1939 | Marshall, Jr. et al. | 68/184 |
| 2,223,998 | 12/1940 | Martin et al. | 68/23 R X |
| 2,499,025 | 2/1950 | Horvath | 68/148 X |
| 2,502,965 | 4/1950 | Knapp | 68/54 X |
| 2,549,824 | 4/1951 | Kost | 68/172 |

*Primary Examiner*—Philip R. Coe

*Attorney, Agent, or Firm*—Finnegan, Henderson, Farabow, Garrett & Dunner, L.L.P.

[57] ABSTRACT

A bulged washing tub for a low frequency vibration type washing machine is disclosed. The side wall of the washing tub is outwardly bulged so that this side wall meets with the bottom of the washing tub at an obtuse angle and smoothly guides the heart type or scroll type water current in the washing tub. A plurality of friction prominences of the horizontal stripe type are provided on the inner surface of the outward bulged side wall. The prominences give frictional force to clothes when the clothes are rubbed against them while coming up and going down along with the water current in the washing tub. The frictional force caused by the prominences causes a so-called washboard effect and makes the clothes cleaned as if they were manually washed using a washboard.

1 Claim, 2 Drawing Sheets

FIG. 1
PRIOR ART
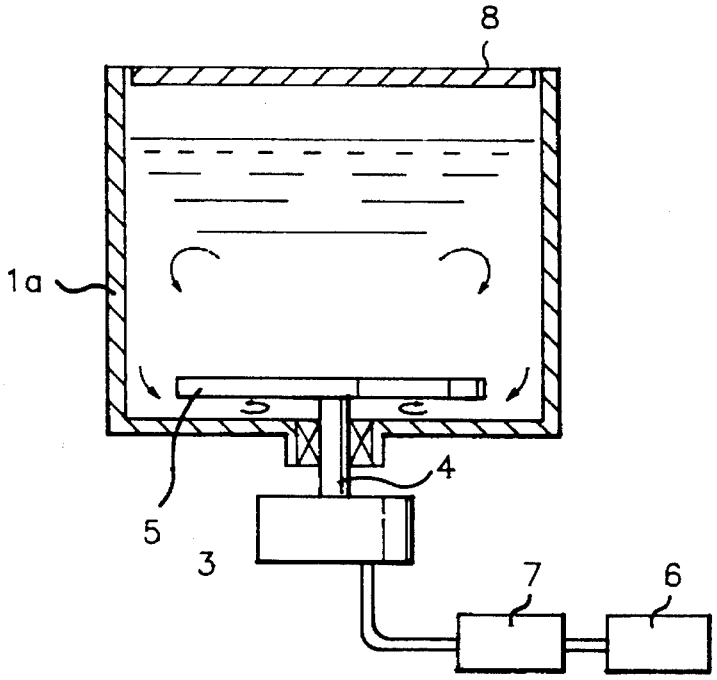
FIG. 2A
PRIOR ART
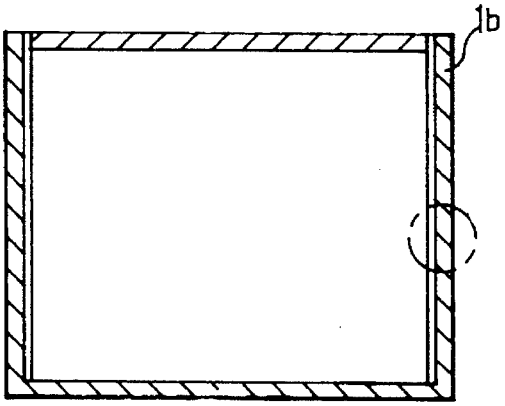
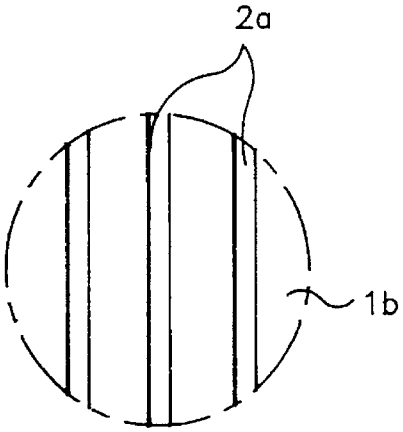
FIG. 2B
PRIOR ART FIG. 3A
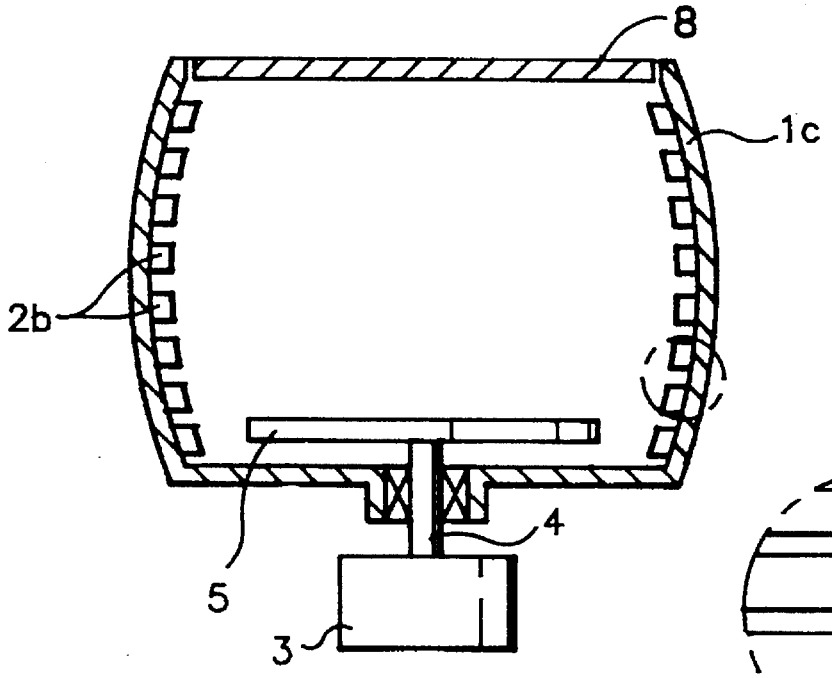
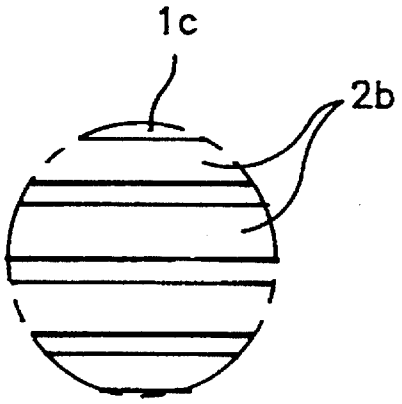
FIG. 3B

WASHING TUB FOR LOW FREQUENCY VIBRATION TYPE WASHING MACHINE

This application is a continuation of application Ser. No. 08/257,327 filed Jun. 7, 1994, now abandoned.

BACKGROUND OF THE INVENTION

1. Field of the Invention

The present invention relates in general to automatic washing machines using low frequency vibration to wash clothes and, more particularly, to an improved structure in washing tubs of such washing machines for causing smooth circulation of water current and giving frictional force to clothes circulated in the water current.

2. Description of the Prior Art

In order to wash clothes in a conventional automatic washing machine using low frequency vibration, a low frequency oscillating disc placed in a washing tub generates a specified low frequency vibration which causes resonance phenomena in a multi-phase washing medium in the washing tub. Here, the multi-phase washing medium is made of water, detergent and air. The level of low frequency is specified in accordance with the shape of the washing tub, the shape of the oscillating disc and the mixing ratio of the multi-phase washing medium.

In the above washing machine, the desired mechanical washing effect is achieved by the micro air bubbles generated by cavitation of the oscillating disc or nonlinear vibration. Both the cavitation and the nonlinear vibration are generated in the multi-phase medium at the same time as the generation of the resonance phenomena. The mechanical washing effect caused by the cavitation or the nonlinear vibration cooperates with a chemical washing effect caused by the detergent in the washing medium, thus to achieve the desired washing effect.

With reference to FIG. 1, there is shown a typical automatic washing machine using low frequency vibration. The washing machine generally comprises a washing tub 1*a* receiving the multi-phase washing medium therein. A low frequency oscillating disc 5 causing the resonance phenomena in the washing medium is placed in the washing tub 1*a* and coupled to an actuator 3 through a shaft 4. The shaft 4 transmits the drive force of the actuator 3 to the disc 5 so as to drive this disc 5. The actuator 3, which is mounted on the outer bottom of the washing tub 1*a*, is applied with an amplitude signal and a frequency signal from a signal oscillator 6. A signal amplifier 7 is placed on a signal line between the actuator 3 and the signal oscillator 6 for amplifying and varying the signals generated by the signal oscillator 6.

There is provided a gap between the inner bottom of the washing tub 1*a* and the disc 5 for allowing the disc 5 to vertically vibrate. A lid 8 is provided in the opening of the washing tub 1*a* for hermetically covering the opening.

In operation of the above washing machine, the low frequency oscillating disc 5 is driven by the actuator 3 in response to signals applied from the signal oscillator 6 to the actuator 3 through the signal amplifier 7. This disc 5 thus vibrates in order to cause the resonance phenomena in the multi-phase washing medium in the washing tub 1*a*. Here, the desired mechanical washing effect is achieved by the micro air bubbles generated by cavitation of the oscillating disc 5 or nonlinear vibration, which cavitation and nonlinear vibration are generated in the multi-phase medium at the same time as the generation of the resonance phenomena.

The above mechanical washing effect cooperates with the chemical washing effect caused by the detergent in the washing medium, thus to achieve the desired washing effect.

In washing clothes using the low frequency vibration, the signal oscillator 6 makes the disc 5 vibrate in an oscillation frequency band of 20–250 Hz, an amplitude band of 2–25 mm and a rotational amplitude band of 2°–10°. Here, the signal amplifier 7 amplifies current signals or voltage signals which are to be applied from the signal oscillator 6 to the actuator 3.

However, it has been noted that the above washing machine has the following problems.

Since the side wall of the cylindrical washing tub 1*a* meets with the bottom of the washing tub 1*a* at right angles, the washing tub 1*a* can not smoothly guide the heart type or scroll type current of washing medium. This disturbs the clothes from smooth circulation in the current and deteriorates the washing effect.

In addition, the washing tub 1*a* of the low frequency vibration washing machine is simply flat on the inner surface of its side wall in contrast with the washing tub 1*b* of a typical pulsator type washing machine of FIGS. 2A and 2B. With the flat surface, the washing tub 1*a* gives produces no frictional force to the clothes circulated in the washing medium. Frictional force is known to cause a so-called "washboard effect" that doubles the washing effect. In this regard, the washing tub 1*a* does not achieve the desired washing effect.

FIGS. 2A and 2B show the washing tub 1*b* of a typical pulsator type washing machine. In washing clothes washing in the pulsator type washing machine, the clothes are circulated along with the washing medium current in the washing tub 1*b* as a result the rotation of a pulsator (not shown). Here, the inner surface of the side wall of the washing tub 1*b* is uneven so as to form a plurality of friction prominences 2*a* of the vertical stripe type. With the uneven structure, the washing tub 1*b* produces a frictional force, which causes the washboard effect and doubles the washing effect, to the clothes circulated in the washing medium. The frictional force caused by the washing tub 1*b* having the uneven inner side surface makes the clothes cleaned as if they were manually washed using a washboard.

SUMMARY OF THE INVENTION

It is, therefore, an object of the present invention to provide a bulged washing tub for a low frequency vibration type washing machine in which the aforementioned problems can be overcome and which causes smooth circulation of washing medium current of the heart type or scroll type and gives a frictional force to clothes circulated in the washing medium current.

In order to accomplish the above object, a washing tub for a low frequency vibration type washing machine in accordance with a preferred embodiment of the present invention comprises an outward bulged side wall, the side wall meeting with a bottom of the washing tub at an obtuse angle and smoothly guiding a heart type or scroll type water current in the washing tub; and a plurality of friction prominences provided on an inner surface of the outward bulged side wall, the prominences giving frictional force to clothes when the clothes are rubbed against them while coming up and going down along with the water current in the washing tub.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a sectional view of a typical washing machine using a low frequency vibration in its washing operation;

FIGS. 2A and 2B are respectively a sectional view of a washing tub of a typical pulsator type washing machine and an enlarged fragmentary plan view of an interior portion of the tub side wall; and FIGS. 3A and 3B are respectively a sectional view of a washing tub and an enlarged fragmentary plan of an interior portion of the tub side wall of a low frequency vibration type washing machine in accordance with a preferred embodiment of the present invention.

DESCRIPTION OF THE PREFERRED EMBODIMENTS

In the following description, those elements common to both the embodiments of this invention and the prior art embodiment of FIG. 1 will carry the same reference numerals.

With reference to FIGS. 3A and 3B, there is shown a washing tub 1*c* of a low frequency vibration type washing machine in accordance with a preferred embodiment of the present invention. The side wall of the washing tub 1*c* is outwardly bulged and has a plurality of friction prominences 2*b* of the horizontal stripe type on its inner surface. An oscillating disc 5 is placed in the bulged washing tub 1*c* for generating the resonance phenomena in the multi-phase washing medium in the washing tub 1*c*. The oscillating disc 5 is coupled to a disc drive actuator 3 through a shaft 4.

In the conventional manner, there is provided a gap between the inner bottom of the bulged washing tub 1*c* and the disc 5 for allowing the disc 5 to vertically vibrate. A lid 8 is provided in the opening of the washing tub 1*c* for covering the opening.

In operation of the low frequency vibration type washing machine having the bulged washing tub 1*c* of this invention, the low frequency oscillating disc 5 is driven by the actuator 3 in response to signals applied from the signal oscillator 6 to the actuator 3 through the signal amplifier 7. This disc 5 thus vibrates in order to cause the resonance phenomena in the multi-phase washing medium in the washing tub 1*c*. Here, the desired mechanical washing effect is achieved by the micro air bubbles generated by cavitation of the oscillating disc 5 or nonlinear vibration, which cavitation and nonlinear vibration are generated in the multi-phase medium at the same time as the generation of the resonance phenomena. The above mechanical washing effect cooperates with the chemical washing effect caused by the detergent in the washing medium, thus to achieve the washing effect.

During the washing off clothes by both the mechanical washing effect caused by the cavitation or nonlinear vibration of the multi-phase washing medium and the chemical washing effect caused by the detergent, the washing effect is doubled by the washing medium current of the heart type or of the scroll type in the bulged washing tub 1*c*. Since the side wall of the washing tub 1*c* is outwardly bulged as described above, the bulged side wall meets with the bottom of the washing tub 1*c* at an obtuse angle. With the bulged structure of the side wall, the washing tub 1*c* more smoothly guides the washing medium current of the heart type or of the scroll type. That is, the upward current of the washing medium is smoothly guided to the upper section of the bulged washing tub 1*c* and, thereafter, smoothly guided to the bottom section of the washing tub 1*c*. The bulged washing tub 1*c* thus improves the washing effect.

During the washing of the clothes, the clothes suspended in the washing medium repeatedly come up to the surface and go down to the bottom along with the washing medium current. The clothes repeatedly coming up to the surface and going down to the bottom along with the washing medium current are applied with both the trailing force of the current and the force of gravity. A resultant force of the trailing force of the current and the force of gravity makes the clothes rub against the inner surface of the side wall of the washing tub 1*c*. Here, the outward bulged side wall of the washing tub 1*c* is provided with the plurality of horizontal prominences 2*b* of the stripe type on its inner surface as described above, so that the clothes coming up and going down in the washing medium are rubbed against the prominences 2*b*. The clothes are thus applied with the frictional force causing the washboard effect. With the washboard effect caused by the horizontal prominences 2*b* of the bulged washing tub 1*c*, the washing effect is remarkably improved.

The above washing tub 1*c* exhibits the following advantages.

The washing tub is outwardly bulged in its side wall, thus to become an outward bulged washing tub. The outward bulged side wall meets with the bottom of the washing tub at an obtuse angle. With the outward bulged side wall, the washing tub smoothly guides the washing medium current of the heart type or of the scroll type. The smooth circulation of the washing medium current causes a smooth circulation of clothes. This improves the washing effect.

In addition, the bulged side wall of the washing tub is provided with a plurality of horizontal prominences of the stripe type on its inner surface. These prominences give frictional force to the clothes when the clothes are rubbed against them due to the resultant force of the trailing force of the current and the force of gravity applied to the clothes. With the frictional force causing the so-called washboard effect, the washing tub makes the clothes cleaned as if the clothes were manually washed using a washboard.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A low frequency vibration type washing machine comprising:

a washing tub having a disc disposed therein;

means for oscillating the disc in said washing tub;

said washing tub having an outwardly bulged side wall having an inner surface, said side wall meeting with a bottom of the washing tub at an obtuse angle and cooperating with said oscillating means to smoothly guide heart type water currents flowing up and going down in said washing tub; and a plurality of ring-shaped friction prominences disposed in parallel, vertically spaced relation to one another along substantially the entire height of the inner surface of said outwardly bulged side wall of said washing tub, said prominences exerting frictional force on clothes rubbing against said prominences while the clothes move up and down along with said water currents in the washing tub.

* * * * *